US006929561B2

(12) United States Patent
Chang

(10) Patent No.: US 6,929,561 B2
(45) Date of Patent: Aug. 16, 2005

(54) PUTTING INSTRUCTOR

(76) Inventor: Chen Te Chang, P.O. Box 63-298, Taichung (TW) 406

( * ) Notice: Subject to any disclaimer, the term of this patent is extended or adjusted under 35 U.S.C. 154(b) by 25 days.

(21) Appl. No.: 10/735,456

(22) Filed: Dec. 10, 2003

(65) Prior Publication Data

US 2005/0130756 A1 Jun. 16, 2005

(51) Int. Cl.[7] ..... A63B 69/36
(52) U.S. Cl. ..... 473/257; 473/260
(58) Field of Search ..... 473/150, 218, 473/219, 220, 257, 258, 261, 264, 229, 259, 473/260, 265, 266

(56) References Cited

U.S. PATENT DOCUMENTS

| | | | | |
|---|---|---|---|---|
| 2,084,901 A | * | 6/1937 | Eisenberg | 473/229 |
| 2,084,902 A | * | 6/1937 | Eisenberg | 473/229 |
| 2,340,793 A | * | 2/1944 | Chapman | 473/229 |
| 3,558,139 A | * | 1/1971 | Brandell et al. | 473/162 |
| 4,437,669 A | * | 3/1984 | Pelz | 473/265 |
| 4,544,160 A | * | 10/1985 | Miner | 473/218 |
| 5,246,233 A | * | 9/1993 | Sheltman et al. | 473/265 |
| 5,435,547 A | * | 7/1995 | Lee | 473/225 |
| 5,707,301 A | * | 1/1998 | Tollin | 473/257 |
| 5,797,804 A | * | 8/1998 | Chen | 473/260 |
| 6,805,639 B2 | * | 10/2004 | Maruszczak | 473/190 |

FOREIGN PATENT DOCUMENTS

| | | | | |
|---|---|---|---|---|
| GB | 2020983 A | * | 11/1979 | A63B 69/36 |
| WO | WO 03/063971 A1 | * | 8/2003 | A63B 69/36 |

* cited by examiner

*Primary Examiner*—Gregory Vidovich
*Assistant Examiner*—Nini F. Legesse
(74) *Attorney, Agent, or Firm*—Charles E. Baxley

(57) ABSTRACT

A putting instructor includes two rails each having a curved upper surface corresponding to a curved moving pathway of a golf club head while swinging the golf club head relative to the rails, and a link coupled the rails together, to maintain a gap formed between the rails. The curved upper surfaces of the rails are used to guide users to practice putting exercises. Each of the rails includes a graduation disposed on the curved upper surface. Each of the rails includes an outer bulge higher than an inner bar, to form a shoulder between the inner bar and the outer bulge, and having a graduation disposed on a curved upper surface.

18 Claims, 14 Drawing Sheets

PUTTING INSTRUCTOR

BACKGROUND OF THE INVENTION

1. Field of the Invention

The present invention relates to a putting instructor, and more particularly to a putting instructor having an adjustable configuration for changing to various operating conditions.

2. Description of the Prior Art

Various kinds of typical putting instructors have been developed and comprise a planar mat having a hole formed therein for practicing golf games.

However, the typical putting instructors may not be used to train or to instruct the users to practice putting exercises or operations.

The present invention has arisen to mitigate and/or obviate the afore-described disadvantages of the conventional putting instructors.

SUMMARY OF THE INVENTION

The primary objective of the present invention is to provide a putting instructor including an adjustable configuration for changing to various operating conditions.

In accordance with one aspect of the invention, there is provided a putting instructor comprising two rails each including a curved upper surface formed thereon, corresponding to a curved moving pathway of a golf club head while swinging the golf club head relative to the rails, and a link coupled the rails together, to maintain a gap formed between the rails. The curved upper surfaces of the rails are provided to guide users to practice putting exercises.

Each of the rails includes a graduation provided on the curved upper surface thereof. Each of the rails includes an inner bar having the curved upper surface provided thereon, and includes an outer bulge extended therefrom and having a height greater than that of the inner bar, to form a shoulder between the inner bar and the outer bulge.

The outer bulge of each of the rails includes a curved upper surface formed thereon. Each of the outer bulges includes a graduation provided on the curved upper surface thereof.

Each of the rails includes a plurality of depressions formed therein, the link includes at least two teeth provided thereon to engage into the depressions of the rails, and to adjustably secure the rails together, and to adjust the gap formed between the rails. The rails include a first end having the link coupled therebetween, and includes a second end, and a second link coupled between the second ends of the rails. The link includes an aperture formed therein, and a pin selectively engaged into the aperture of the link.

A target member may further be provided and includes a hole formed therein for receiving the golf ball. The target member includes a ramp formed thereon and directed toward the rails. The target member includes a flag attached thereon. A cable may further be provided and selectively coupled between the flag and the pin.

Two blocks may further be provided and secured to the rails respectively. Each of the blocks includes an inner bar having a curved upper surface provided thereon, and an outer bulge extended therefrom and having a height greater than that of the inner bar, to form a shoulder between the inner bar and the outer bulge, and having a curved upper surface formed on each of the outer bulges.

Each of the inner bar and the outer bulges includes a plurality of depressions formed therein, the link includes at least two teeth provided thereon to engage into the depressions of the rails, and to adjustably secure the blocks together, and to adjust the gap formed between the blocks.

Two seats may further be provided and secured to the rails respectively. Each of the seats includes an inner bar having a curved upper surface provided thereon, and an outer bulge extended therefrom and having a height greater than that of the inner bar, to form a shoulder between the inner bar and the outer bulge, and having a curved upper surface formed on each of the outer bulges.

Each of the inner bar and the outer bulges includes a plurality of depressions formed therein, the link includes at least two teeth provided thereon to engage into the depressions of the rails, and to adjustably secure the seats together, and to adjust the gap formed between the seats.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
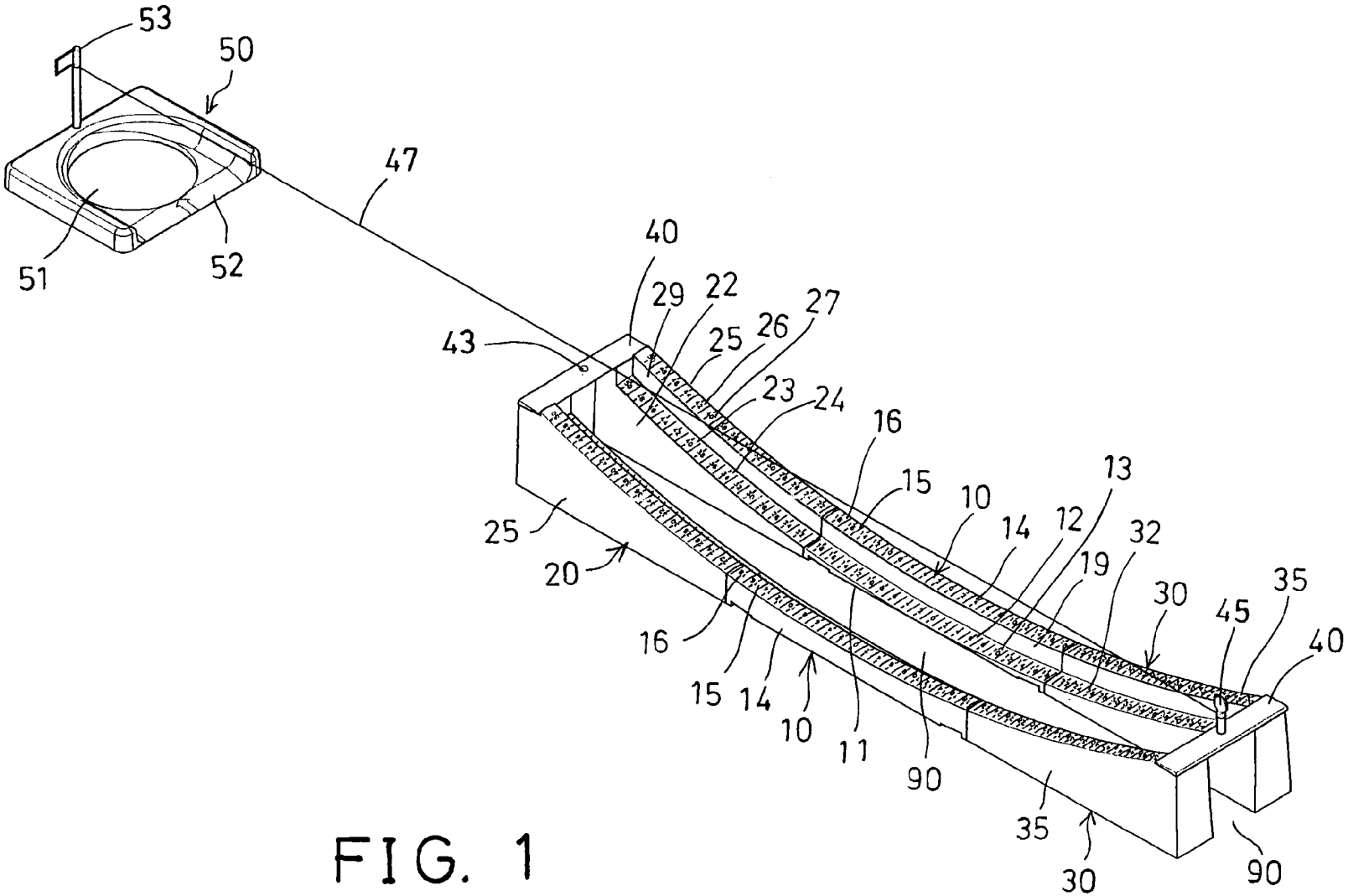
FIG. 1 is a perspective view of a putting instructor in accordance with the present invention.
Figure 2:
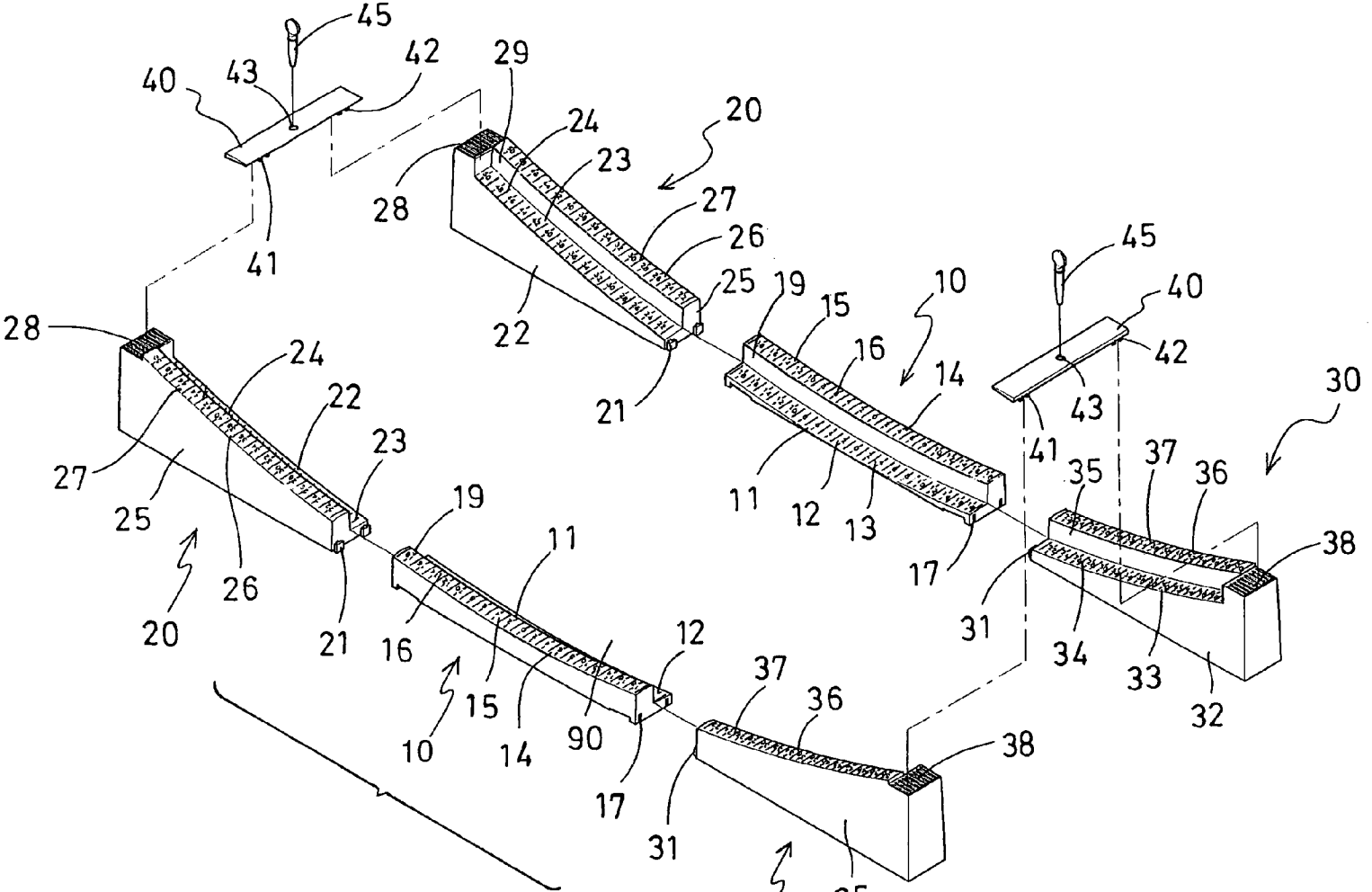
FIG. 2 is an exploded view of the putting instructor, as seen from one direction thereof, such as seen from the front or the rear portion thereof.
Figure 3:
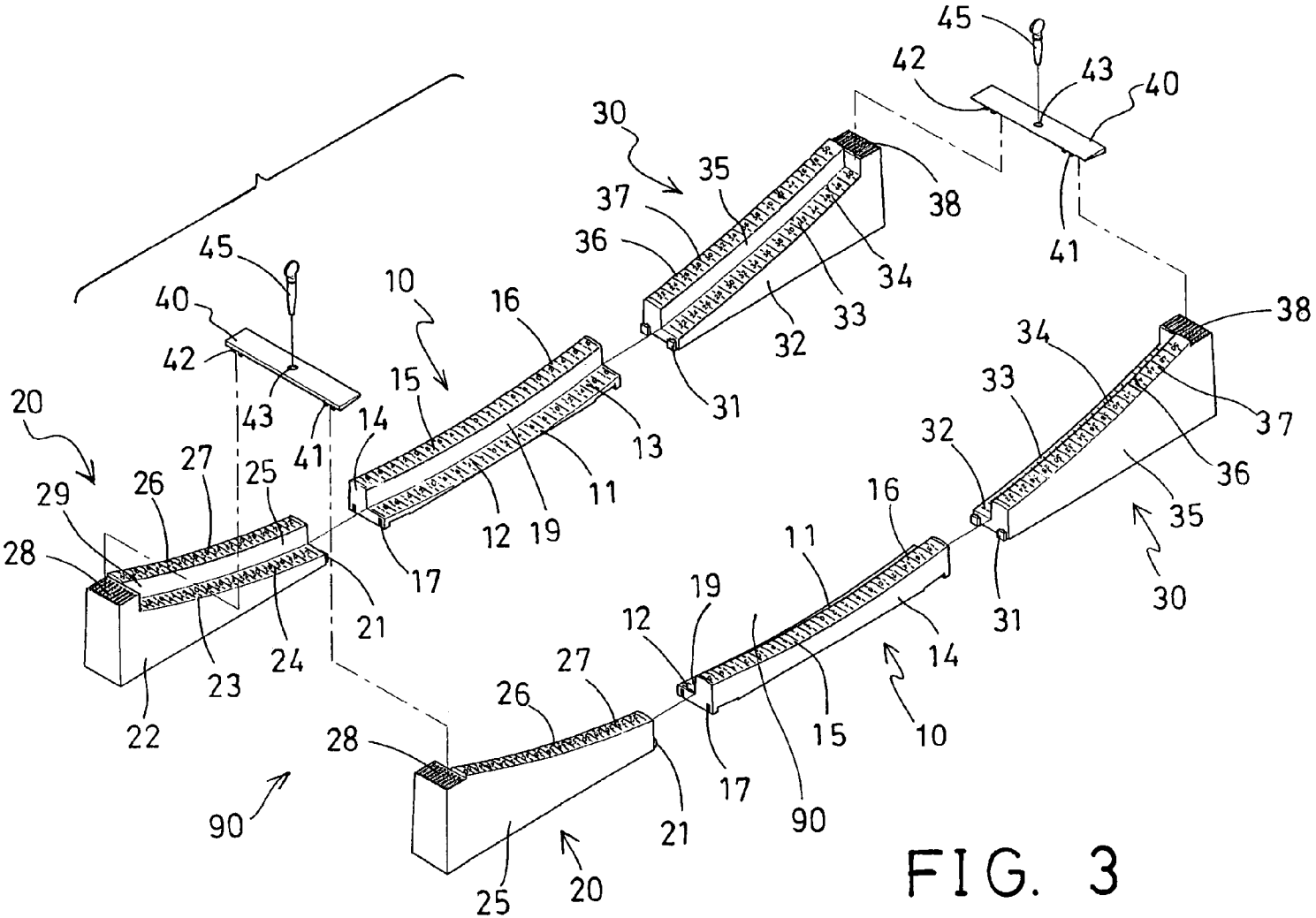
FIG. 3 is an exploded view similar to FIG. 2, as seen from the other direction opposite to that shown in FIG. 2.

Referring to the drawings, and initially to FIGS. 1–4, a putting instructor in accordance with the present invention comprises two rails 10 which are preferably disposed or arranged parallel to each other. Each of the rails 10 includes an inner bar 11 having a curved upper surface 12 formed thereon, and a graduation 13 formed or provided on the curved upper surface 12 thereof.

Each of the rails 10 further includes an outer bulge 14 extended upwardly from the outer portion thereof and also having a curved upper surface 15 formed thereon, and a graduation 16 formed or provided on the curved upper surface 15 thereof. The outer bulge 14 includes a height greater than that of the inner bar 11 to form a shoulder 19 between the outer bulge 14 and the inner bar 11. Each of the rails 10 includes two ends each having one or more cavities 17 formed thereon.

Two blocks 20 may further be provided and are preferably disposed or arranged parallel to each other. Each of the blocks 20 includes one or more projections 21 extended therefrom for engaging into the corresponding cavities 17 of the rails 10, and for securing the blocks 20 to the rails 10 with such as force-fitted engagements, latch engagements, fasteners (not shown), or the like.

Each of the blocks 20 further includes an inner bar 22 having a curved upper surface 23 formed thereon, and a graduation 24 formed or provided on the curved upper surface 23 thereof, and an outer bulge 25 extended upwardly from the outer portion thereof and also having a curved upper surface 26 formed thereon, and a graduation 27 formed or provided on the curved upper surface 26 thereof.

The outer bulge 25 includes a height greater than that of the inner bar 22 to form a shoulder 29 between the outer bulge 25 and the inner bar 22. Each of the blocks 20 includes one end having a number of teeth or depressions 28 formed on the upper portion thereof.

Figure 5:
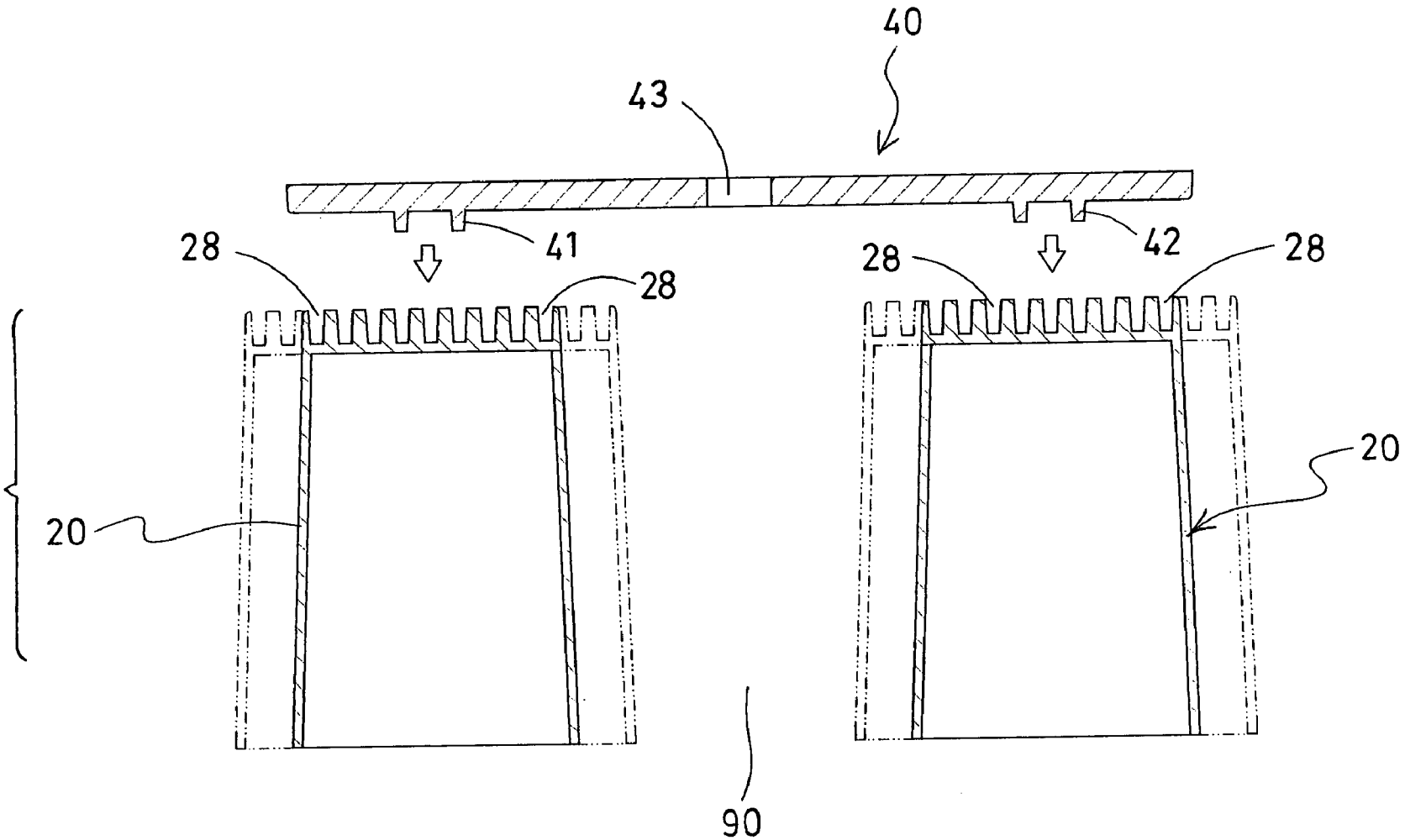
FIG. 5 is a partial exploded and partial cross sectional view of the putting instructor, illustrating an adjusting operation of the putting instructor.

A link 40 includes one or more depressions or teeth 41, 42 formed or extended therefrom, such as extended from each of the end portions thereof, for engaging into the teeth or depressions 28 of the blocks 20, and for adjustably securing the blocks 20 together. The distance or the gap 90 between the blocks 20 may thus be adjusted to different width by engaging the depressions or teeth 41, 42 into the corresponding teeth or depressions 28 of the blocks 20, best shown in FIG. 5.

Two seats 30 may further be provided and are preferably disposed or arranged parallel to each other. Each of the seats 30 includes one or more projections 31 extended therefrom for engaging into the corresponding cavities 17 of the rails 10, and for securing the seats 30 to the rails 10 with such as force-fitted engagements, latch engagements, fasteners (not shown), or the like.

Each of the seats 30 further includes an inner bar 32 having a curved upper surface 33 formed thereon, and a graduation 34 formed or provided on the curved upper surface 33 thereof, and an outer bulge 35 extended upwardly from the outer portion thereof and also having a curved upper surface 36 formed thereon, and a graduation 37 formed or provided on the curved upper surface 36 thereof.

The outer bulge 35 includes a height greater than that of the inner bar 32 to form a shoulder 39 between the outer bulge 35 and the inner bar 32. Each of the seats 30 includes one end having a number of teeth or depressions 38 formed on the upper portion thereof.

The link 40 or another link 40 includes one or more depressions or teeth 41, 42 formed or extended therefrom, such as extended from each of the end portions thereof, for engaging into the teeth or depressions 38 of the seats 30, and for adjustably securing the seats 30 together. The distance or the gap 90 between the seats 30 may thus be adjusted to different width by engaging the depressions or teeth 41, 42 into the corresponding teeth or depressions 38 of the seats 30.

Figure 4:
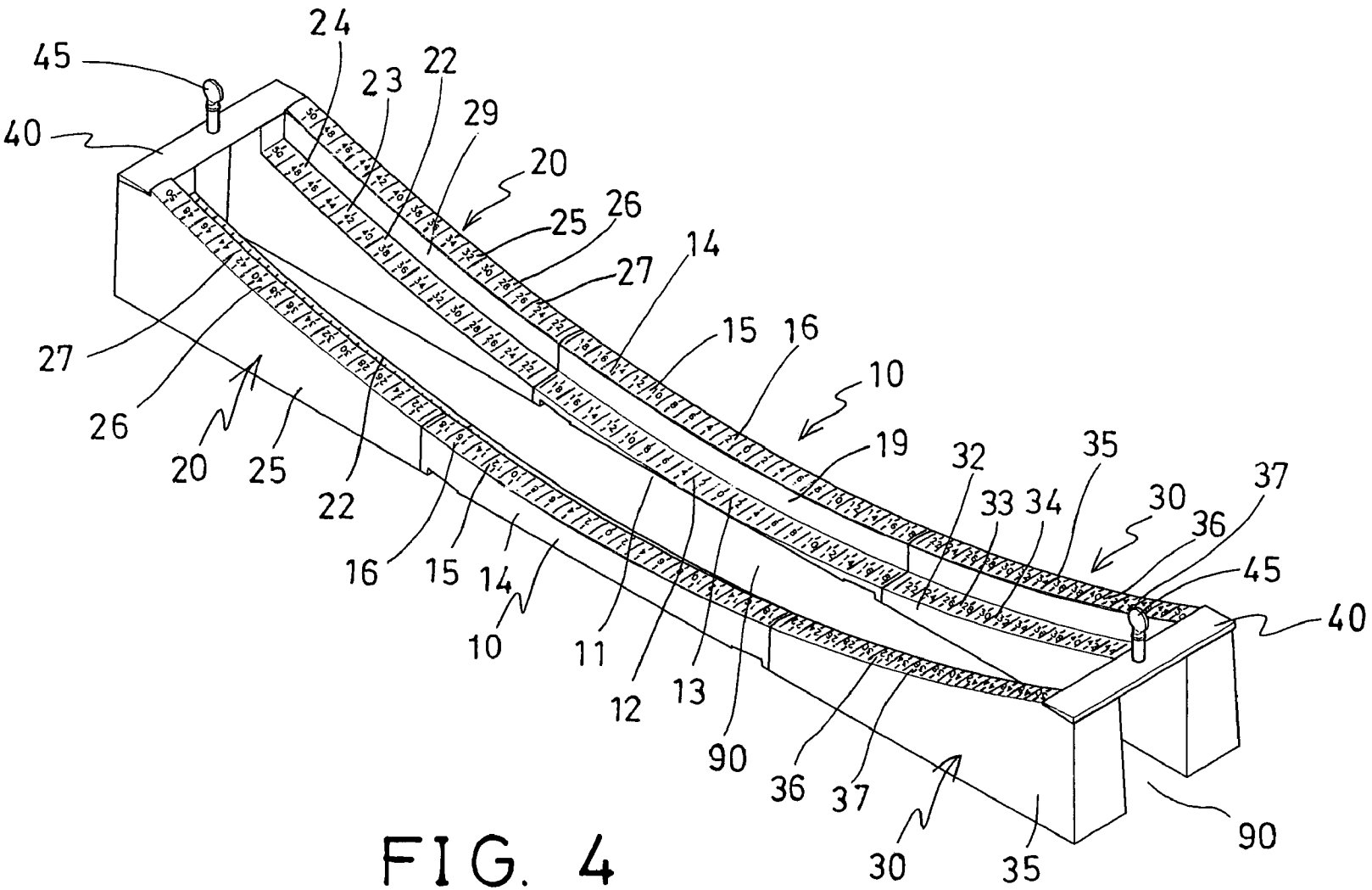
FIG. 4 is a perspective view of the putting instructor, having a target member removed.
Figure 7:
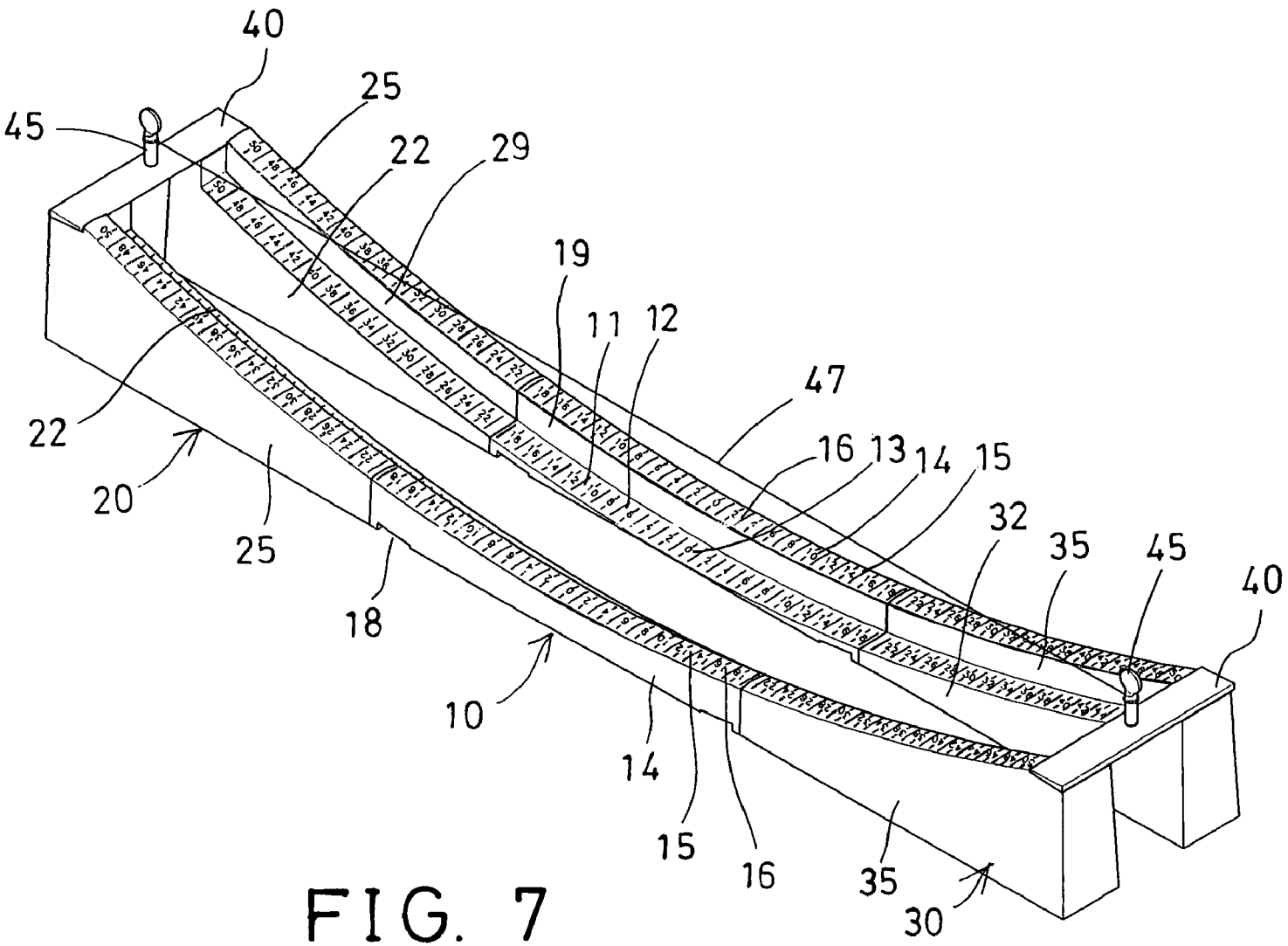
FIG. 7 is a perspective view similar to FIG. 4, illustrating the other operating condition of the putting instructor.

Each of the links 40 may include an aperture 43 formed therein, such as formed in the center portion thereof, for engaging a pin 45 thereto (FIG. 4). For example, as shown in FIG. 7, a thread or a cable 47 may further be provided and coupled between the pins 45, for indicating the center between the rails 10 and/or the blocks 20 and/or the seats 30, or the center of the gap 90 formed between the rails 10 and/or the blocks 20 and/or the seats 30.

Figure 6:
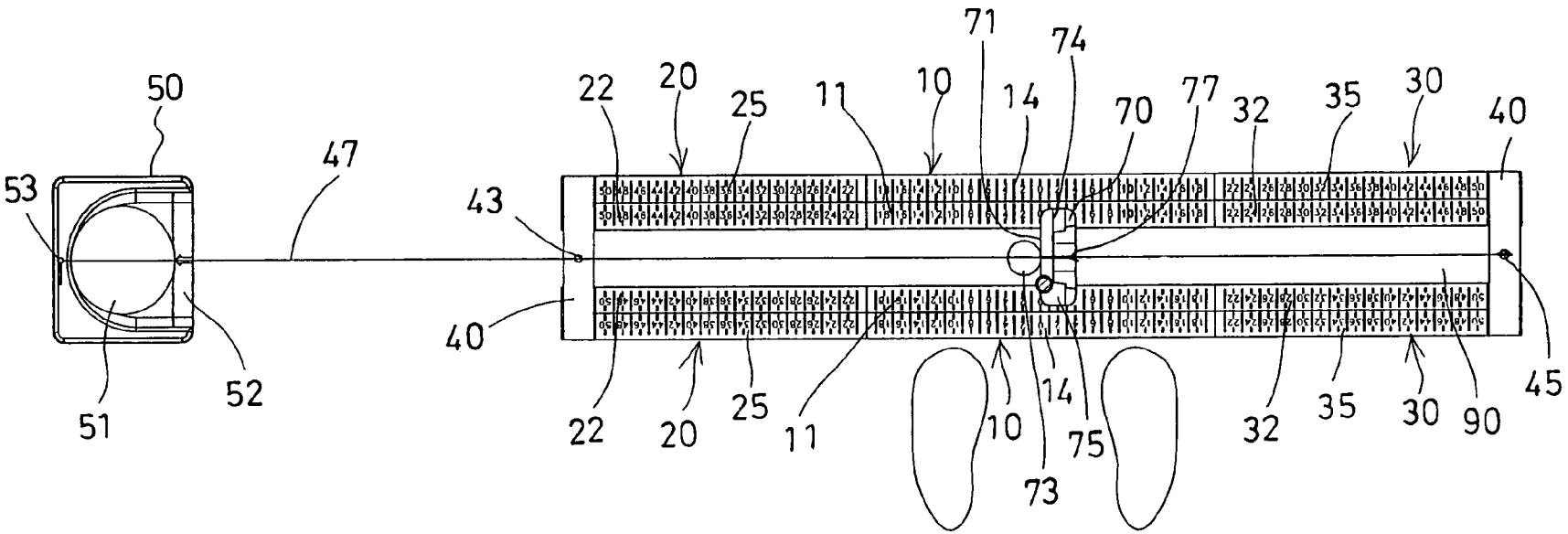
FIG. 6 is a top plan schematic view illustrating the putting training or operation of the putting instructor.

As shown in FIGS. 1 and 6, a target member 50 may further be provided and disposed and spaced away from the rails 10 and/or the blocks 20 and/or the seats 30, and includes a hole 51 formed therein, a ramp 52 formed in front of the hole 51 and directed toward the rails 10 and/or the blocks 20 and/or the seats 30, and includes a flag 53 attached thereto, for indicating the hole 51 of the target member 50.

Figure 8:
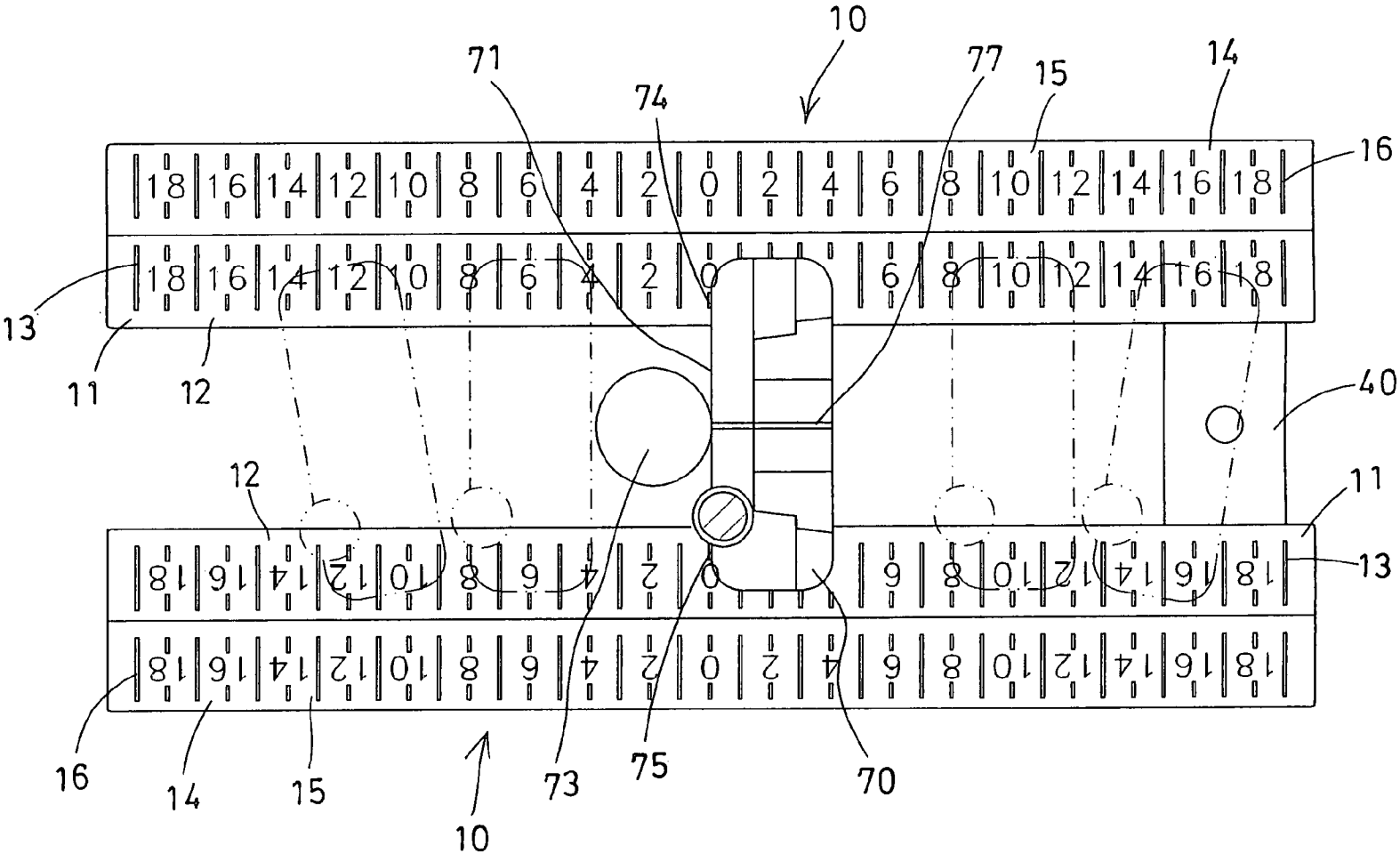
FIG. 8 is an enlarged partial top plan schematic view illustrating the putting training or operation of the putting instructor.
Figure 9:
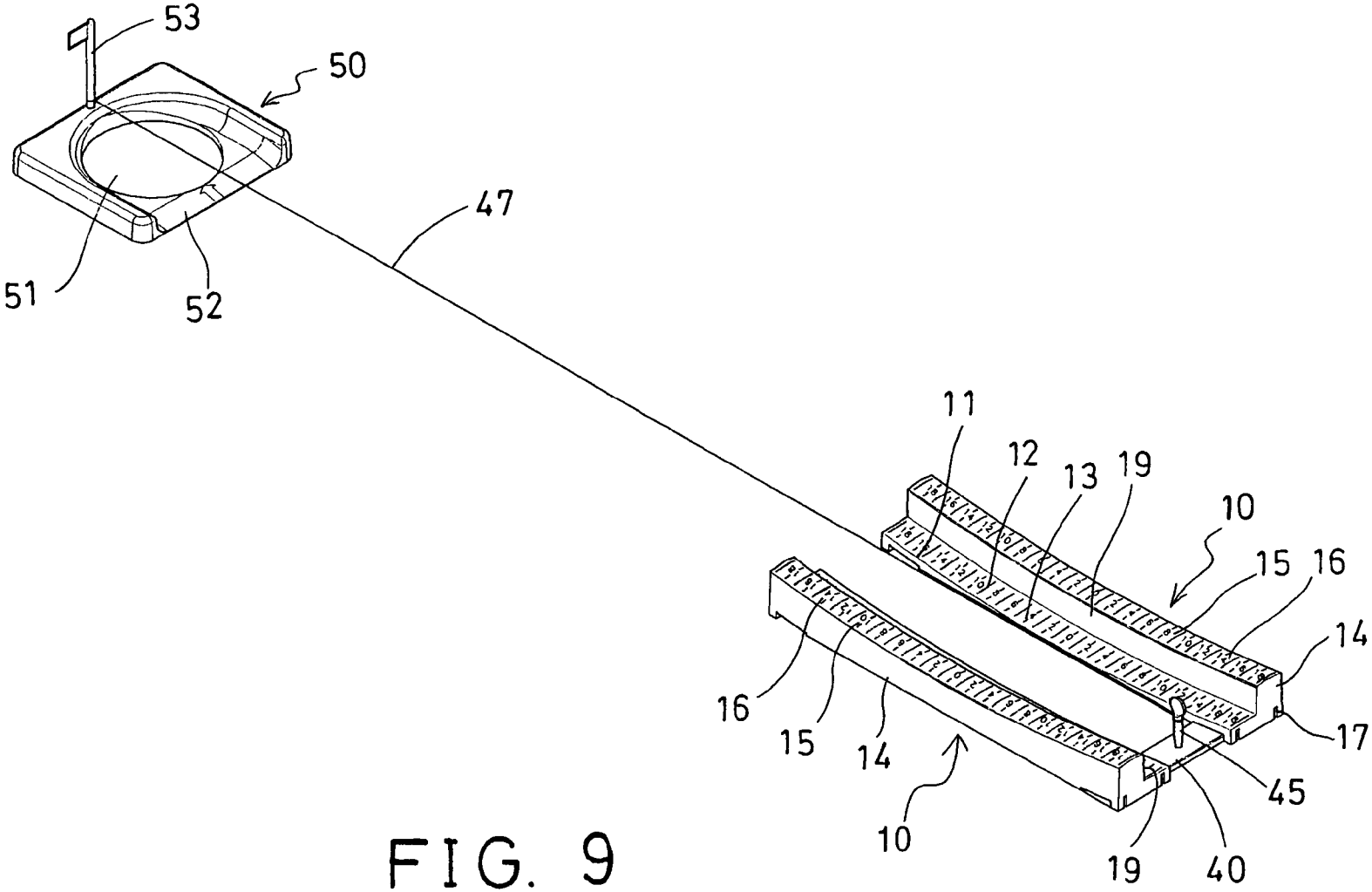
FIGS. 9, 10, 11 are perspective views illustrating the further operating condition of the putting instructor.

In operation, as shown in FIGS. 6 and 8, the target member 50 is disposed and spaced away from the rails 10 and/or the blocks 20 and/or the seats 30 for a suitable distance, and the cable 47 may be coupled between the flag 53 and the pin 45 of the link 40 that is disposed on top of the seats 30. The golf club head 70 may be disposed between the cable 47 and the inner bars 11 of the rails 10, and disposed above the curved surfaces 12 of the inner bars 11 of the rails 10.

The users may direct or face the striking surface 71 of the golf club head 70 toward a golf ball 73, and may direct or align the end portions 74, 75 of the striking surface 71 with the graduations 13 of the inner bars 11, or with the graduations 16 of the outer bulges 14, in order to train or practice putting operations or to adjust to different or suitable putting postures or gestures. The hole 51 of the target member 50 may be used to receive the golf ball 73. The golf club head 70 may include an indicator or a pointer 77 for aligning with the cable 47.

It is to be noted that the golf club head 70 may be swung or moved in a curved moving pathway while putting by the users. The curved surfaces 12 of the inner bars 11 and the curved surfaces 15 of the outer bulges 14 of the rails 10 preferably include a predetermined or suitable curvature corresponding to the curved moving pathway the golf club head 70, to allow the users to easily align the end portions 74, 75 of the striking surface 71 with the graduations 13 of the inner bars 11, or with the graduations 16 of the outer bulges 14.

Figure 15:
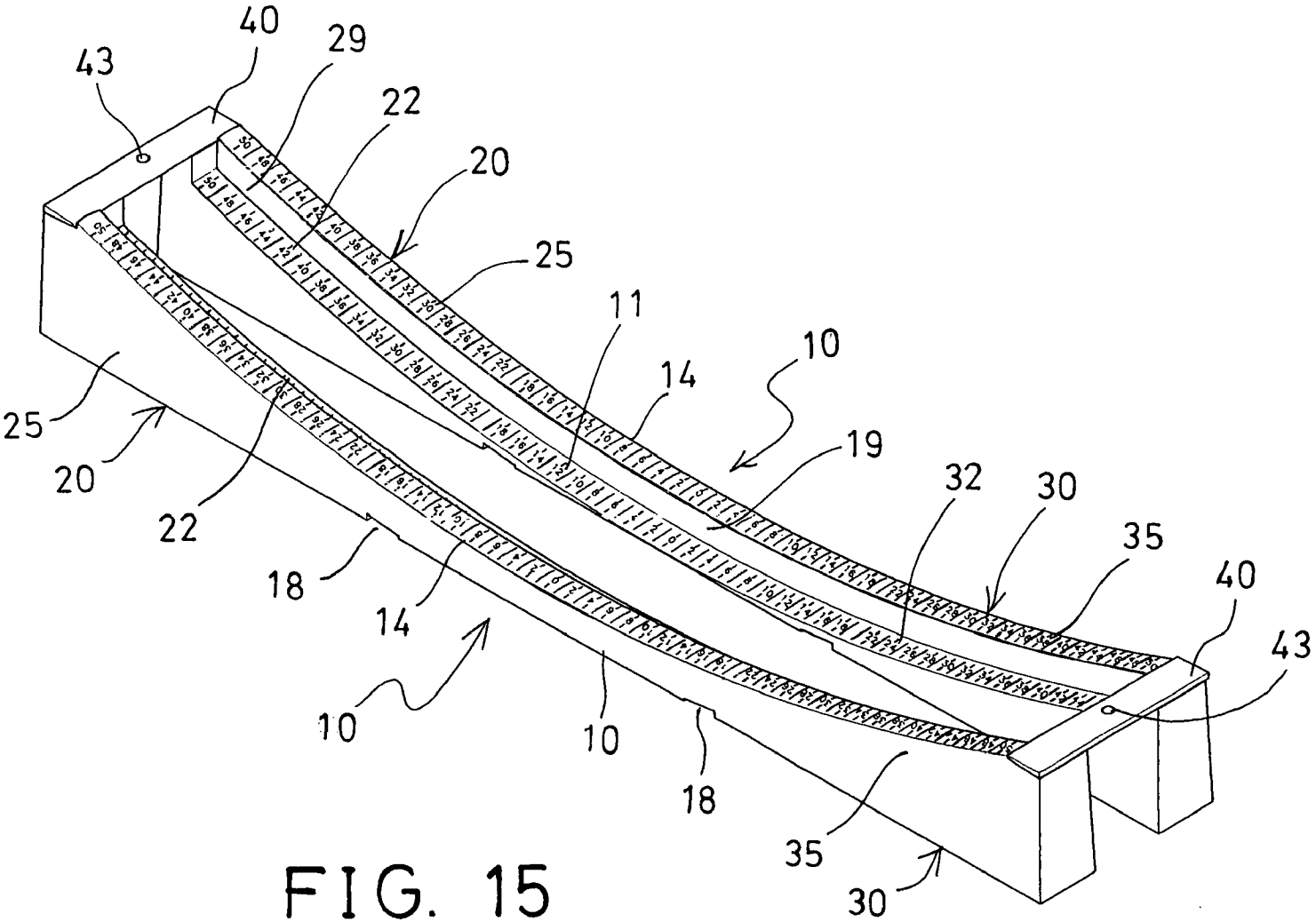

After practicing, the users may have increased experiences, and the cable 47 may then be coupled between the pins 45, as shown in FIG. 7, to guide the users to put the golf ball 73, instead of being coupled between the flag 53 and the pin 45 of the link 40. Alternatively, as shown in FIG. 4, the cable 47 may also be removed from the flag 53 or from the pin 45 of the link 40, for putting guide purposes. Further alternatively, as shown in FIG. 15, the rails 10 and/or the blocks 20 and/or the seats 30 may be formed together as a one integral piece.

After further practicing, the users may have further increased experiences, and the cable 47 may then be coupled between the pins 45, as shown in FIGS. 8–12, the blocks 20 and the seats 30 may be removed from the rails 10, and the users may use only the rails 10 for putting guide purposes.

Figure 13:
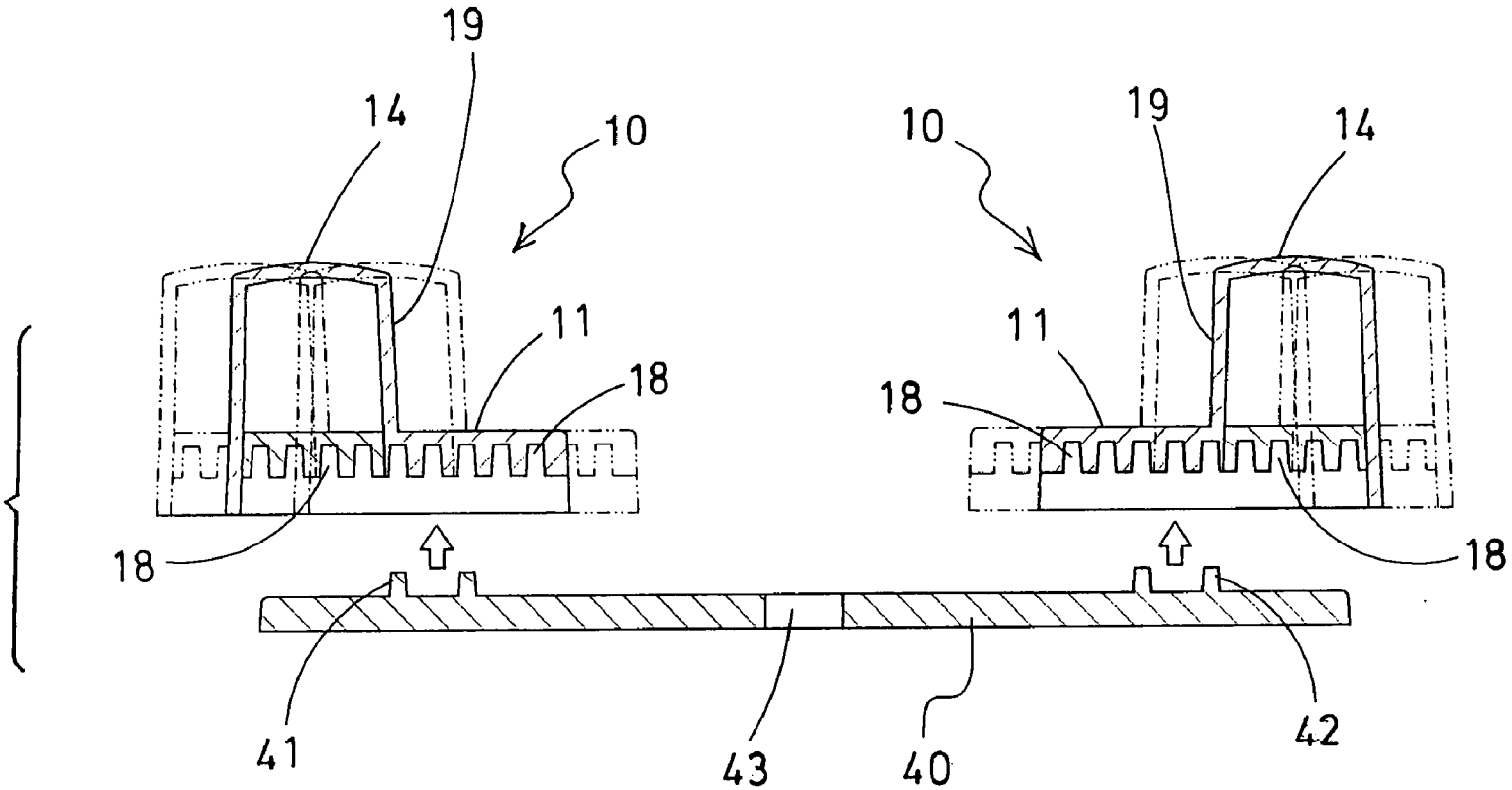
FIG. 13 is a partial exploded and partial cross sectional view of the putting instructor as shown in FIGS. 11, 12, illustrating the other adjusting operation of the putting instructor.

As shown in FIGS. 8–13, and particularly in FIG. 13, each of the rails 10 includes one or both ends each having a number of teeth or depressions 18 formed therein, such as formed in the bottom portion thereof. The links 40 may engage their depressions or teeth 41, 42 into the corresponding teeth or depressions 18 of the rails 10, to adjustably secure the seats 30 together, and to adjust the distance or the gap 90 between the rails 10.

Figure 11:
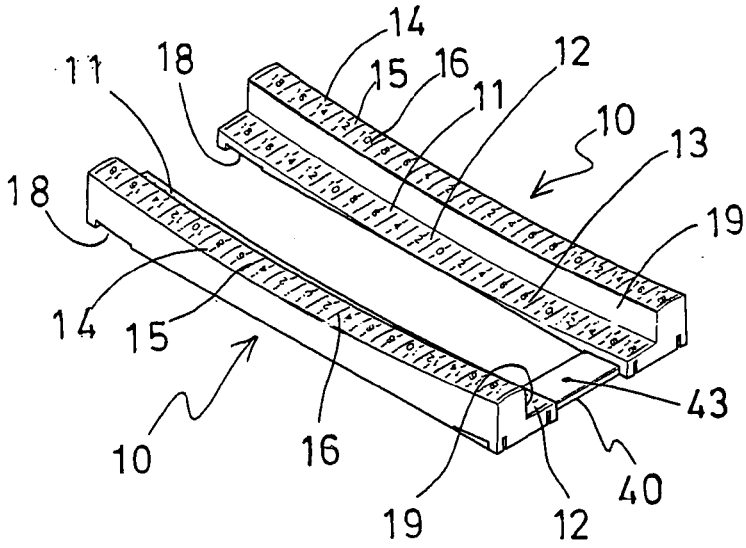
Figure 10:
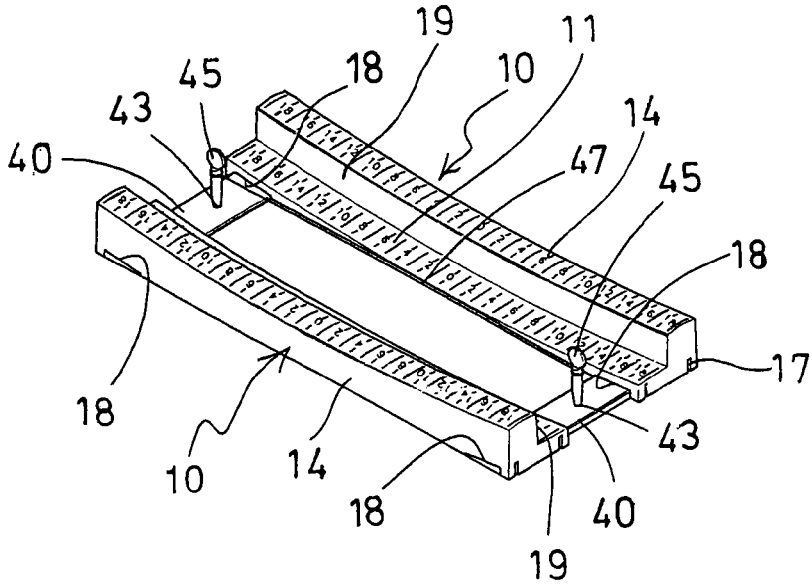
Figure 12:
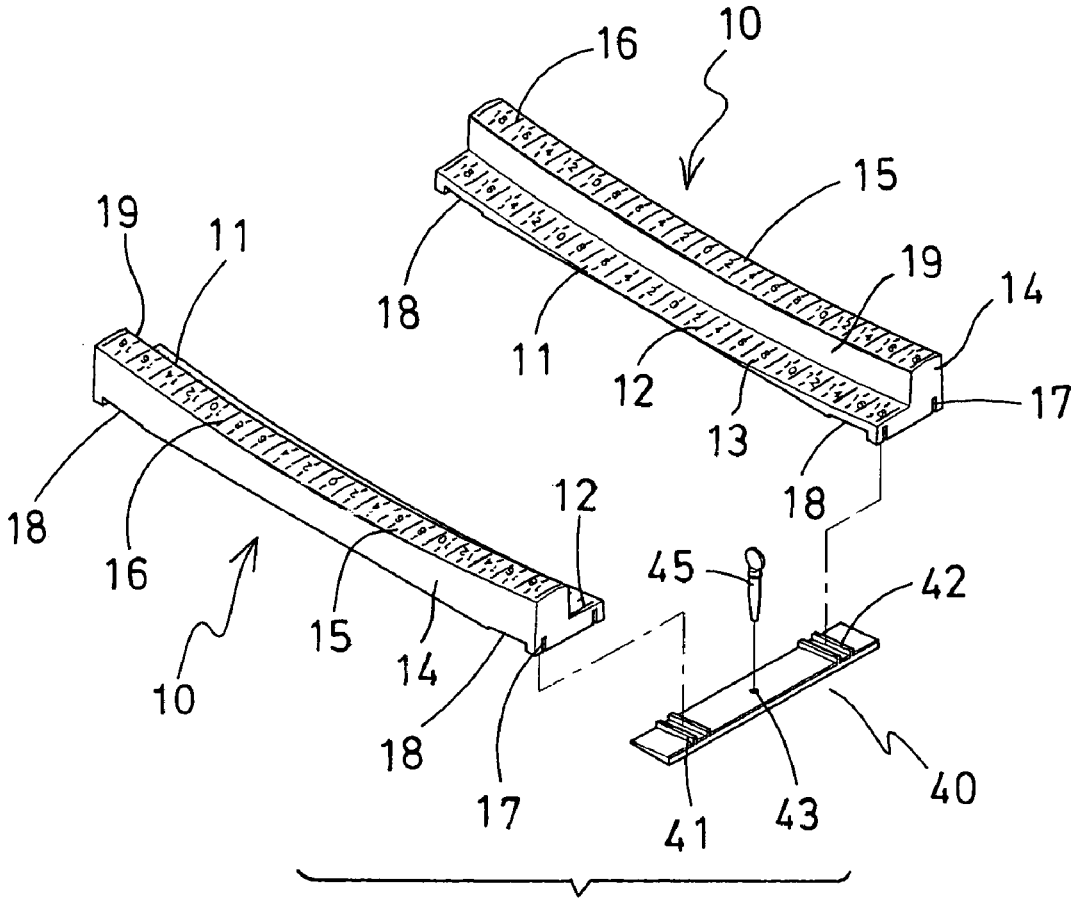
FIG. 12 is an exploded view of the putting instructor as shown in FIG. 11.

The cable 47 may be coupled between the flag 53 and the pin 45 of the link 40 that is disposed on the bottom of the rails 10 (FIG. 9), to guide the users to put the golf ball 73. As shown in FIG. 10, the cable 47 may also be coupled between the pins 45 of the links 40 that are disposed on the bottom of the ends of the rails 10. Alternatively, as shown in FIG. 11, the cable 47 may also be removed from the flag 53 or from the pin 45 of the link 40, and the pin 45 may also be removed from the link 40 for putting guide purposes.

Figure 14:
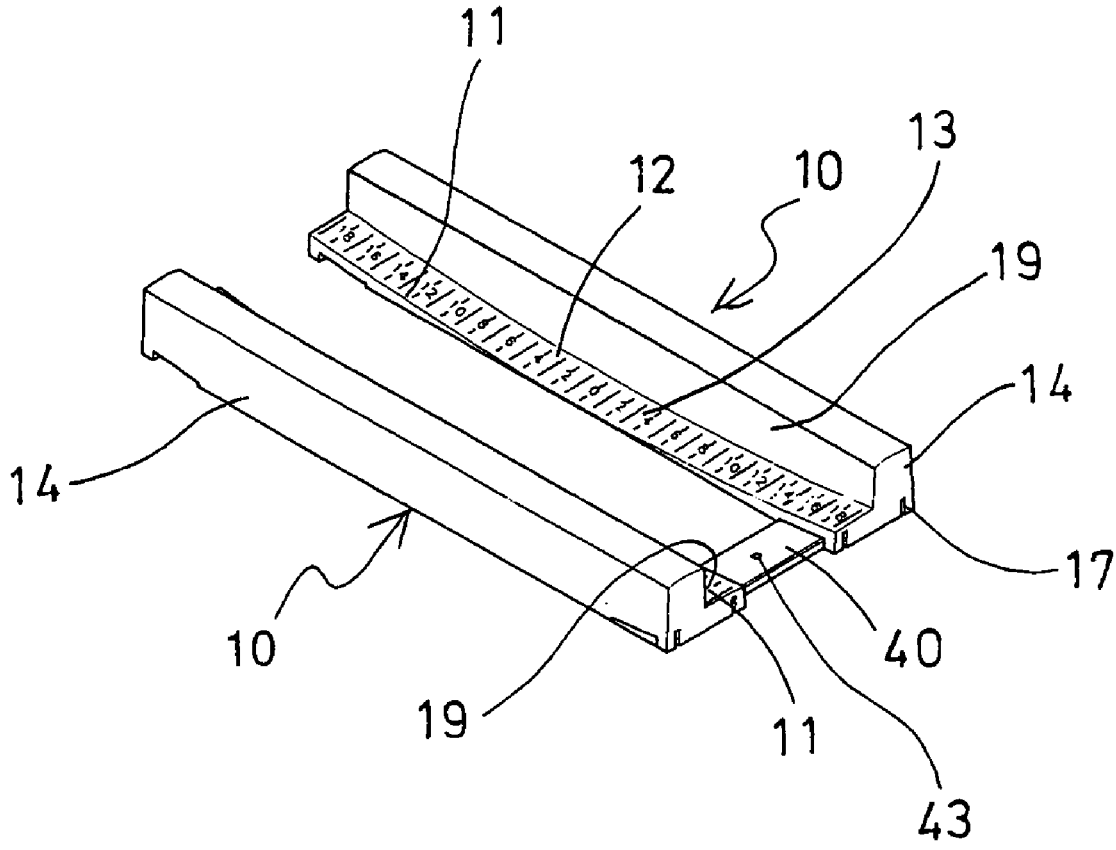
FIGS. 14, 15 are perspective views illustrating the still further operating conditions of the putting instructor.

Alternatively, as shown in FIG. 14, the bulges 14 of the rails 10 may include a flat upper surface, instead of the curved upper surfaces 15 as shown in the other drawing figures.

Accordingly, the putting instructor in accordance with the present invention includes an adjustable configuration for changing to various operating conditions.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A putting instructor comprising:

two rails each including a curved upper surface formed thereon, corresponding to a curved moving pathway of a golf club head while swinging the golf club head relative to said rails, and each of said rails including a plurality of depressions formed therein, and a link coupled said rails together, to maintain a gap formed between said rails, said link including at least two teeth provided thereon to engage into said depressions of said rails, and to adjustably secure said rails together, and to adjust the gap formed between said rails, said curved upper surfaces of said rails being provided to guide users to practice putting exercises.

2. The putting instructor as claimed in claim 1, wherein each of said rails includes a graduation provided on said curved upper surface thereof.

3. The putting instructor as claimed in claim 1, wherein each of said rails includes an inner bar having said curved upper surface provided thereon, and includes an outer bulge extended therefrom and having a height greater than that of said inner bar, to form a shoulder between said inner bar and said outer bulge.

4. The putting instructor as claimed in claim 3, wherein said outer bulge of each of said rails includes a curved upper surface formed thereon.

5. The putting instructor as claimed in claim 4, wherein each of said outer bulges includes a graduation provided on said curved upper surface thereof.

6. The putting instructor as claimed in claim 1, wherein said rails include a first end having said link coupled therebetween, and includes a second end, and a second link coupled between said second ends of said rails.

7. The putting instructor as claimed in claim 1, wherein said link includes an aperture formed therein, and a pin selectively engaged into said aperture of said link.

8. The putting instructor as claimed in claim 1 further comprising a target member having a hole formed therein for receiving the golf ball.

9. The putting instructor as claimed in claim 8, wherein said target member includes a ramp formed thereon and directed toward said rails.

10. The putting instructor as claimed in claim 8, wherein said target member includes a flag attached thereon.

11. The putting instructor as claimed in claim 10, wherein said link includes a pin attached thereon.

12. The putting instructor as claimed in claim 11 further comprising a cable selectively coupled between said flag and said pin.

13. The putting instructor as claimed in claim 1 further comprising two blocks secured to said rails respectively.

14. The putting instructor as claimed in claim 1 further comprising two seats secured to said rails respectively.

15. The putting instructor as claimed in claim 14, wherein each of said seats includes an inner bar having a curved upper surface provided thereon, and an outer bulge extended therefrom and having a height greater than that of said inner bar, to form a shoulder between said inner bar and said outer bulge, and having a curved upper surface formed on each of said outer bulges.

16. A putting instructor comprising:

two rails each including a curved upper surface formed thereon, corresponding to a curved moving pathway of a golf club head while swinging the golf club head relative to said rails, a link coupled said rails together, to maintain a gap formed between said rails, said curved upper surfaces of said rails being provided to guide users to practice putting exercises, and two blocks secured to said rails respectively, each of said blocks including an inner bar having a curved upper surface provided thereon, and an outer bulge extended therefrom and having a height greater than that of said inner bar, to form a shoulder between said inner bar and said outer bulge, and having a curved upper surface formed on each of said outer bulges.

17. The putting instructor as claimed in claim 16, wherein each of said inner bar and said outer bulges includes a plurality of depressions formed therein, said link includes at least two teeth provided thereon to engage into said depressions of said rails, and to adjustably secure said blocks together, and to adjust the gap formed between said blocks.

18. A putting instructor comprising:

two rails each including a curved upper surface formed thereon, corresponding to a curved moving pathway of a golf club head while swinging the golf club head relative to said rails, a link coupled said rails together, to maintain a gap formed between said rails, said curved upper surfaces of said rails being provided to guide.

* * * * *